United States Patent [19]

Terauchi

[11] Patent Number: 4,697,580

[45] Date of Patent: Oct. 6, 1987

[54] BODY MASSAGE APPARATUS WITH DEMOUNTABLE VIBRATOR

[75] Inventor: Ryugo Terauchi, Tokyo, Japan

[73] Assignee: Nippon Rehabili-Medical Corporation, Yokohama, Japan

[21] Appl. No.: 789,683

[22] Filed: Oct. 21, 1985

[51] Int. Cl.[4] ..... A61H 1/00

[52] U.S. Cl. ..... 128/36; 128/35

[58] Field of Search ..... 128/36, 35

[56] References Cited

U.S. PATENT DOCUMENTS

| | | | |
|---|---|---|---|
| 854,983 | 5/1907 | Clark | 128/36 |
| 2,228,934 | 1/1941 | Tjomsland | 128/36 |
| 2,287,501 | 6/1942 | Thomas | 128/36 |
| 3,291,123 | 12/1966 | Terauchi | 128/36 |
| 3,314,418 | 4/1967 | Tiemes | 128/36 |
| 4,025,809 | 5/1977 | Teranishi | 128/36 |
| 4,102,334 | 7/1978 | Muchisky | 128/36 |
| 4,343,303 | 8/1982 | Williams | 128/36 |
| 4,469,092 | 9/1984 | Marshall et al. | 128/36 |

FOREIGN PATENT DOCUMENTS

| | | | |
|---|---|---|---|
| 740340 | 11/1955 | United Kingdom | 128/36 |

*Primary Examiner*—Edgar S. Burr
*Assistant Examiner*—Tonya Lamb
*Attorney, Agent, or Firm*—Bernard L. Kleinke

[57] ABSTRACT

A body massage apparatus for propagating vibrations of a vibrator to a selected part of the human body through a pad member. The body massage apparatus generally includes a case in which a motor is mounted for producing vibrations. The attaching components, are secured to the case for attaching a selected pad member thereto, and they comprise a dial rotatably mounted in the case, and directly accessible to the user, for engagement with the pad member.

17 Claims, 4 Drawing Figures

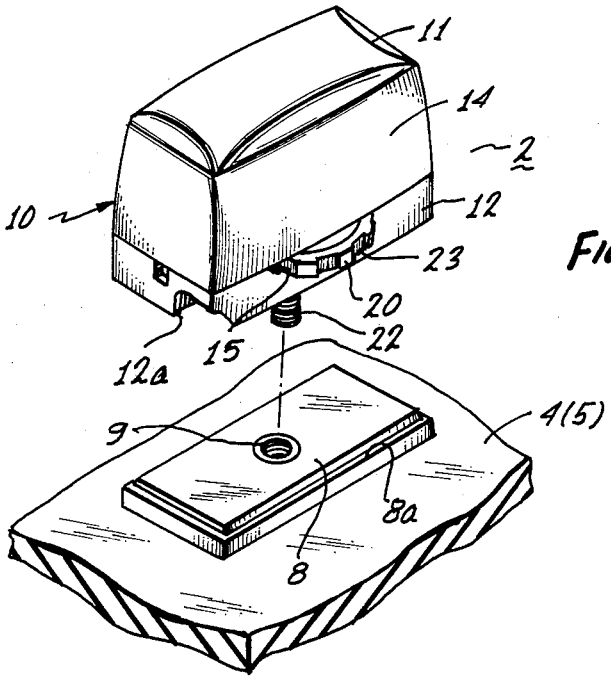
FIG. 2
FIG. 3
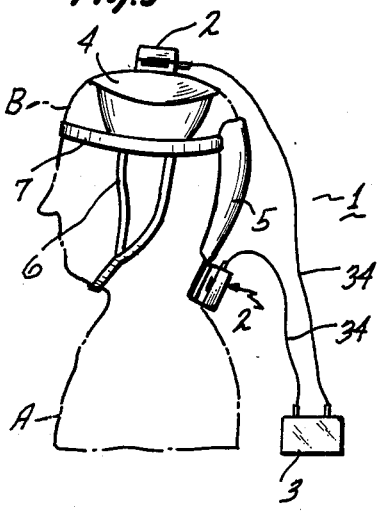
FIG. 4
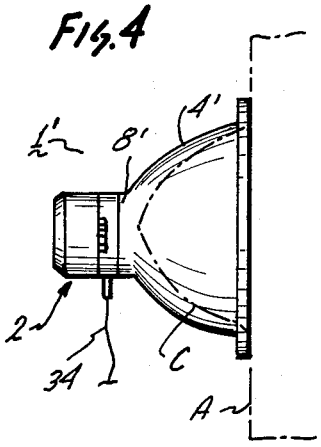

BODY MASSAGE APPARATUS WITH DEMOUNTABLE VIBRATOR

DESCRIPTION

1. Technical Field

This invention relates generally to a massager designed to propagate the vibrations of a vibrator into the human body through a pad member.

2. Background Art

As is well known, devices for administering a massage to various parts of the human body have been contrived, such as that disclosed in Japanese Patent Publication No. 21475/65. In such a device, a vibrator is set securely in a pad member, and the vibrations generated by the vibrator are propagated through the pad to the part of the human body being treated, to thereby apply a massage to that part.

With a conventional massage device, it is impossible to easily remove the vibrator from the pad member, so that when transporting the device or storing it when not in use, it can not be easily disassembled, and hence it can not be packed compactly in a handy case or other convenient covering. In addition, when massaging different parts of the human body, it is necessary to prepare a corresponding number of pad members which have shapes conforming to those parts of the body being treated, and this also necessitates the same number of vibrators, making the device very expensive.

DISCLOSURE OF INVENTION

The present device has been developed to eliminate these problems in the prior art, and the gist of the device resides in a massager which is designed to propagate the vibrations of a vibrator to the human body through a pad member. The vibrator comprises a case; a dial rotatably housed in the case and having centrally thereon an externally-threaded, vertical bar; and a motor which is also set in the case. The case has openings in both sides thereof through which the dial partly projects and also a hole in a bottom portion thereof through which the externally-threaded, vertical bar of the dial passes so that the bar projects out of the case. The pad member has a seat for receiving the bottom portion of the vibrator, and a tapped hole into which said externally-threaded bar of the dial is screwed is formed in the seat.

BRIEF DESCRIPTION OF DRAWINGS

The above-mentioned and other objects and features of this invention and the manner of attaining them will become apparent, and the invention itself will be best understood, by reference to the following description of an embodiment of the invention taken in conjunction with the accompanying drawings.

FIG. 2 is a perspective view of a vibrator and its seat provided on a pad member;

FIG. 3 is a side view of a head massager in use; and

FIG. 4 is a side view of a bust massager.

DETAILED DESCRIPTION

Figure 1:
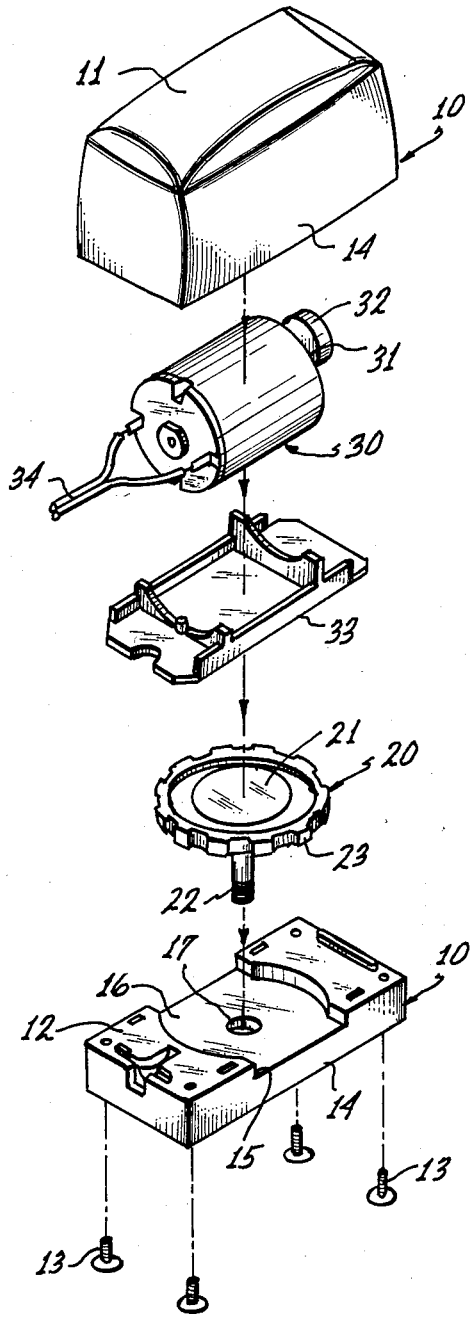
FIG. 1 of the drawings is an exploded perspective view of a vibrator constructed in accordance with the invention.

An embodiment of the present device will be described below with reference to FIGS. 1–3 of the accompanying drawings.

Referring to FIG. 3, numeral 1 designates generally a head massager in accordance with the present invention. The head massager 1 consists of two vibrators 2 and 2A which are features of the present device, a vibration controller 3 connected electrically to the two vibrators 2 and 2A, a pair of pad members 4 and 5 made of a soft rubber capable of propagating the vibrations from the vibrators to the head portion B of a human body A, and attachment bands 6 and 7 connected to the pad members 4 and 5, for securing the pad members to the appropriate parts of the head.

Each of the vibrators 2 and 2A, as illustrated in FIGS. 1 and 2, comprises a case 10, a dial 20 rotatably housed in the case 10, and a motor 30 also mounted in the case 10.

The case 10 is divided into an upper cover 11 and a lower cover 12 which can be joined together by screws 13. Openings 15 are formed in both sides 14 of the case 10. A recess 16 is formed at the center of the upper side of the lower cover 12 so as to extend to both sides of the case, as illustrated in FIG. 1, so that when the upper cover 11 and lower cover 12 are connected together, the recess 16 opens from both sides of the case. A hole 17 is also formed at the center of the bottom portion, that is, in the lower cover 12 of the case 10.

The dial 10 has a disc-shaped operating portion 21 and an externally-threaded bar or rod 22. The operating portion 21 is rotatably disposed in the recess 16 of the lower cover 12 so that it partly projects, as indicated by numeral 23, from the openings 15 of the case 10. The externally-threaded bar 22 extends vertically downward from the center of the underside of the operating portion 21, and is passed through the hole 17 in the case 10 so as to project therefrom.

Each of the pair of pad members 4 and 5 is provided with a seat or bearer 8 designed to receive the bottom portion of the lower cover 12 of the vibrator 2 as illustrated for pad member 4 in FIG. 2. The seat 8 has a tapped hole 9 into which the exteranally-threaded bar 22 of the dial 20 is screwed. Around the peripheral edge of the seat 8 is formed a step 8*a* designed to fit against a corresponding protuberance 12*a* formed around the peripheral edge of the lower cover 12.

As illustrated in FIG. 1, the motor 30 is disposed on the upper side of the lower cover 12 on a support plate 33, and a weight 32 is mounted eccentrically on a rotary shaft 31 of the motor 30. The motor 30 is connected to the vibration controller 3 by cables 34.

When using the head massager 1 for massaging the head portion B of the human body A, each of the vibrators 2 or 2A is first mounted suitably on the pair of pad members 4 and 5. This can be accomplished easily in the following way. Each vibrator 2 and 2A is positioned above the seat 8 provided on a corresponding one of pad members 4 and 5, and then the end of the externally-threaded bar 22 of the dial 20 is placed in the tapped hole 9 of the seat 8 and the portions 23 of the dial 20 projecting from the sides 14 of the case 10 are turned to screw the bar 22 into the hole 9. The protuberance 12a at the edge of the lower cover 12 is fitted into the corresponding stepped portion 8a of the seat 8 to ensure that the vibrator 2 and 2A is securely set on the seat 8.

Then the pad members 4 and 5 with the vibrators 2 and 2A thus mounted thereon are attached to the head B, with the pad member 4 placed on the upper side of the head B and the pad member 5 to the rear, as shown in FIG. 3, and they are secured in position by means of the attachement bands 6, 7. The motor 30 of each vibrator 2 and 2A is then energized to turn its shaft 31, resulting in the rotation of the weight 32 secured thereto. Since the weight 32 is mounted on the shaft 31 eccentrically, vibrations are generated by the centrifugal force produced by the rotation of the weight 32, and these vibrations are propagated to the head B through the pad members 4 and 5 to massage the head B.

Each vibrator 2 and 2A can be easily demounted from the corresponding one of the pad members 4 and 5 by simply turning the dial 20 by its projecting portion 23, so that they can be separated and packed compactly in a handy case (not shown) when transporting or storing the device.

As shown in FIG. 4, there is a massager 1', which is constructed in accordance with the present invention, and which is similar to the head massager 1. Like parts are designated with like number followed by a prime notation. Each vibrator, such as the 2', can be easily demounted in a similar manner as the massager, as described above, it can be adapted to another pad mamber 4' designed to fit another part of the human body, for example, a breast C for massaging it. In this case, the pad member 4' is cup-shaped and has a seat 8'. This seat 8' has the same structure and configuration as the seats 8 of the pad members 4 and 5 for head massage', and the vibrator 2' is mounted on the seat 8'. The vibrations generated by the vibrator 2' are propagated to the breast C through the pad member 4' to massage the breast C. Thus, the vibrator 2' can be adapted to different types of pad members such as those illustrated herein with numbers 4, 5 and 4'.

According to the present device as described above, a vibrator can be easily mounted on or demounted from a seat provided on a pad member by simply turning the portions of a dial projecting from openings formed in both sides of the case. Therefore, the vibrator and pad member can be separated and stored compactly in a container. The same vibrator can also be used for massaging different parts of the human body, which leads to a substantial reduction in the cost of the massager.

As various changes may be made in the form, construction, and arrangement of the procedures and parts described herein, without departing from the spirit and scope of the invention and without sacrificing any of its advantages, all matter herein is to be interpreted as illustrative and not in any limiting sense.

What is claimed is:

1. A massage apparatus for propagating vibrations to a part of a user's body, comprising: vibrator means for producing vibrations;

means for propagating said vibrations to selected parts of the user's body, said propagating means being releasably secured to said vibrator means;

attachment means at least partially interposed between said vibrator means and said propagating means, for securing it releasably to said vibrator means; and said attachment means including manually operable means directly accessible to the user for engagement with said propagating means when rotated about its axis in a predetermined direction relative to said propagating means, and for disengagement therefrom when rotated in the opposite direction, said vibrations propagation means includes a pad member adapted to fit over selected parts of the user's body and said manually operable means includes a generally disc-shape member, and an externally-threaded bar depending downwardly axially therefrom, for threadably engaging said pad member.

2. A massage apparatus as recited in claim 1, wherein:

said vibrator means includes a motor, having a weight mounted eccentrically on a rotary shaft thereof.

3. A massage apparatus as recited in claim 1, wherein:

said vibrations propagation means includes a support plate member interposed between said vibrator means and said manually operable means for supporting fixedly said vibrator means atop said manually operable means.

4. A massage apparatus as recited in claim 1, wherein:

said propagating means includes a lower case means removably secured to said pad member.

5. A massage apparatus as recited in claim 4, further comprising:

an upper case means releasably secured to said lower case means, for housing said vibrator means.

6. A massage apparatus as recited in claim 4, wherein:

said lower case means includes a recess for receiving partialy said disc-shaped member, and means for journaling said threaded bar for rotation about its axis.

7. A massage apparatus as recited in claim 1, further including:

means mounting said disc-shaped member atop said lower case means, for causing said lower case means to be interposed between said disc-shaped member and said pad member.

8. A massage apparatus as recited in claim 7, wherein:

said lower case means includes means for journaling said threaded bar for rotation about its axis.

9. A massage apparatus as recited in claim 8, wherein:

said journaling means includes a hole, for receiving partially said threaded bar.

10. A massage apparatus as recited in claim 7, wherein:

said attaching means includes a rigid backing member interposed between said lower case means and said pad member; and said rigid backing member is fixedly attached to said pad member, and includes a female internally threaded part for at least partially receiving said threaded bar.

11. A massage apparatus as recited in claim 10, further comprising:

means for preventing axial rotation of said lower case means during use.

12. A massage apparatus as recited in claim 11, wherein:

said means for preventing includes said lower case means, said lower case means including a protuberance at the bottom peripheral edge thereof; and said backing member includes a corresponding stepped portion along its upper surface, for receiving said protuberance.

13. A body massager for propagating vibrations of a vibrator to a part of the human body through a pad member, comprising:

a case;

motor means mounted within said case, for producing vibrations;

attaching means secured to said case, for removably attaching a selected pad member to said case;

a dial rotatably mounted in said case, said dial having an externally-threaded bar extending from said case for attachment to said selected pad member;

two sides defining openings through which said dial partly projects; and a bottom portion defining a hole through which said externally-threaded bar extends.

14. A massager as recited in claim 13, further comprising:

a weight mounted eccentrically on a rotary shaft of the motor.

15. A massager as recited in claim 13, further comprising:

a pad member shaped and dimensioned to conform to a portion of a human head.

16. A massager as recited in claim 13, further comprising;

a pad member shaped and dimensioned to conform to a human breast.

17. A massager as recited in claim 13, further comprising:

a pad member having a seat member, the seat member having a tapped hole for receiving the externally-threaded bar.

* * * * *